US008885865B2

(12) United States Patent
Yamagishi

(10) Patent No.: US 8,885,865 B2
(45) Date of Patent: Nov. 11, 2014

(54) EARPHONE

(76) Inventor: Makoto Yamagishi, Tokyo (JP)

( * ) Notice: Subject to any disclaimer, the term of this patent is extended or adjusted under 35 U.S.C. 154(b) by 384 days.

(21) Appl. No.: 13/501,736

(22) PCT Filed: Jul. 13, 2011

(86) PCT No.: PCT/JP2011/004014

§ 371 (c)(1),
(2), (4) Date: Apr. 12, 2012

(87) PCT Pub. No.: WO2012/046368

PCT Pub. Date: Apr. 12, 2012

(65) Prior Publication Data

US 2012/0195440 A1 Aug. 2, 2012

(30) Foreign Application Priority Data

Oct. 5, 2010 (JP) ..... 2010-225588

(51) Int. Cl.
*H04R 1/28* (2006.01)
*H04R 1/10* (2006.01)

(52) U.S. Cl.
CPC ..... *H04R 1/2857* (2013.01); *H04R 1/1016* (2013.01)
USPC ..... 381/372; 381/370; 381/354; 381/337; 381/345; 381/182

(58) Field of Classification Search
CPC ..... H04R 1/10; H04R 1/28; H04R 5/033; H04R 1/1083; H04R 1/20; H04R 1/24; H04R 1/2803; H04R 1/2807; H04R 1/2869; H04R 1/30; H04R 1/2857; H04R 1/2853; H04R 1/32; H04R 25/40; H04R 1/323; H04R 1/34; H04R 25/402; H04R 1/36; H04R 25/48; H04R 1/22; H04R 2460/01; H04R 25/652; H40R 5/00
USPC ..... 381/312, 322, 328, 337, 338, 345, 346, 381/352, 353, 182, 370–372, 374, 380, 382, 381/354; 181/175, 193, 194, 196, 198, 199, 181/182, 187, 189, 192
See application file for complete search history.

(56) References Cited

U.S. PATENT DOCUMENTS 4,933,982 A * 6/1990 Tanaka ..... 381/349
6,062,339 A 5/2000 Hathaway (Continued)

FOREIGN PATENT DOCUMENTS

EP 0455203 A1 11/1991
EP 1629801 A1 3/2006

(Continued)

OTHER PUBLICATIONS

Cox, Robyn M., "Comprehensive descriptions of the current state of knowledge in audiology and related disciplines," Monographs in Contemporary Audiology, vol. 1, No. 3, Mar. 1979, pp. 1-46.

*Primary Examiner* — Ahmad F Matar
*Assistant Examiner* — Sabrina Diaz
(74) *Attorney, Agent, or Firm* — Stoel Rives LLP

(57) ABSTRACT

A technology which improves frequency characteristics by an acoustic method so that, when a sound-isolating earphone is attached to a human ear, the sound is heard with natural frequency characteristics is provided. In a sound path from a diaphragm of an electro-acoustic transducer inside a sound-isolating earphone to the eardrum passing through a cylindrical sound leading pipe via the external auditory canal, two independent paths for sound waves are provided in the sound leading pipe, and transfer of the sound with a specific frequency is suppressed by adjusting a difference in length of the paths, whereby the frequency characteristics of the sound passing through this sound path are improved.

7 Claims, 15 Drawing Sheets

(56) References Cited

U.S. PATENT DOCUMENTS

| | | | | |
|---|---|---|---|---|
| 6,307,943 | B1 * | 10/2001 | Yamagishi | 381/312 |
| 2003/0081794 | A1 | 5/2003 | Fushimi et al. | |
| 2006/0133636 | A1 | 6/2006 | Harvey et al. | |

FOREIGN PATENT DOCUMENTS

| | | | |
|---|---|---|---|
| JP | 58043700 | A | 3/1983 |
| JP | 04175097 | A | 6/1992 |
| JP | 08511412 | A | 11/1996 |
| JP | 2000341784 | A | 12/2000 |
| JP | 2007318702 | U | 6/2007 |
| JP | 3160779 | U1 | 6/2010 |
| JP | 3160779 | U1 | 7/2010 |
| WO | 2007089845 | A2 | 8/2007 |

* cited by examiner (a)

(b1)

(b2)

(b1)

(b2)

EARPHONE

TECHNICAL FIELD

The present invention relates to a sound-isolating earphone which is used by inserting a sound emitting portion into an entrance of an external auditory canal.

BACKGROUND ART

The sound-isolating earphone is an ear plug structure as a whole comprising a sound emitting portion with its rear face closed, and an ear pad having a sound exit at the distal end of a portion to be inserted into the external auditory canal formed of soft plastic, rubber or the like having elasticity which is in close contact with the inner face of the external auditory canal without a gap. Since the sound-isolating earphone can be attached by inserting the ear pad into the external auditory canal, the sound-isolating earphone can be reliably attached to the entrance of the external auditory canal. Also, the ear pad is made of a material having flexibility so that the ear pad can be elastically deformed easily in accordance with the shape of the external auditory canal and can provide favorable wearing feeling.

As a result, the sound-isolating earphone which is used by being inserted into the entrance of the external auditory canal has favorable sealing performances, provides high sound isolation, and reduces hearing of external noise, and thus, high sound pressure sensitivity can be obtained and feeble sound can be heard even in a very noisy place. Also, since it can be used by being inserted into the entrance of the external auditory canal, it has an advantage that reduction in size and weight is easy.

In recent years, with spread of portable music players, development of a sound-isolating earphone capable of outputting sound with a good sound quality is in increasing demand.

However, since a prior-art sound-isolating earphone has a structure to seal the external auditory canal, the state of resonance in the external auditory canal changes between before and after the attachment of the earphone, and resonance frequency is displaced and causes a significant defect in the frequency characteristic of the earphone.

Referring to FIG. 1, this point will be described below. FIG. 1 is a schematic diagram of an external auditory canal. When a human being listens to sound, vibration of air generated outside passes an external auditory canal entrance 7 and an external auditory canal 8 and then, reaches an eardrum 9 and vibrates the eardrum 9.

At this time, the external auditory canal 8 is, as illustrated in FIG. 1(*a*), in a state in which one end is closed by the eardrum 9 and the external auditory canal entrance 7, which is the other end, is opened to the atmosphere. That is, it is in a state of a pipe with one end closed and the other end open (hereinafter referred to as one-end closed pipe). Therefore, one-end closed pipe resonance using the external auditory canal 8 as a resonance box occurs. If the one-end closed pipe resonance occurs, standing waves occur and such resonance occurs that the vibration of air at the closed end of the closed pipe becomes the minimum (pressure variation is the maximum), and the vibration of air at the open end of the closed pipe becomes the maximum (the pressure variation is the minimum).

FIG. 1(*b*1) and FIG. 1(*b*2) schematically illustrate the state in which the one-end closed pipe resonance occurs. A solid line indicates a resonance box of the one-end closed pipe, while a broken line indicates amplitude of air vibration.

The frequency characteristics when a sound wave passes through the external auditory canal including the resonance state are found as follows: An expression p1 of a sound wave having a wavelength λ travelling at a speed V from the external auditory canal entrance 7 to the eardrum 9 (this is referred to as a +x direction) at time t can be expressed as follows. Here, reference character A is an arbitrary value:

$$p1(x,t)=A\sin\{2\pi(x-Vt)/\lambda\}.$$

Similarly, a sound wave p2 reflected by the ear drum 9 and travelling at the speed V to the external auditory canal entrance 7 (this is referred to as a −x direction) can be expressed as follows:

$$p2(x,t)=A\sin\{2\pi(x+Vt)/\lambda\}.$$

Since an advancing wave and a sound wave reflected by a closed bottom and returned coexist in the one-end closed pipe, a sound wave P obtained by synthesizing the both can be expressed as follows:

$$\begin{aligned} P(x,t) &= p1(x,t)+p2(x,t) \\ &= A\sin\{2\pi(x-Vt)/\lambda\}+A\sin\{2\pi(x+Vt)/\lambda\} \\ &= A\sin(2\pi/\lambda)\times\sin(2\pi Vt/\lambda). \end{aligned}$$

When this is rewritten using a frequency f with the relationship of λ=V/f, $$P(x,t)=A\sin(2\pi xf/V)\times\sin(2\lambda tf) \qquad \text{(Formula 1)}$$

is obtained.

The first half of the formula of the synthesized sound wave P shows the amplitude at a position x regardless of time, while the second half shows a temporal fluctuation portion, which indicates a standing wave, not a traveling wave. A point where the amplitude is the maximum all the time irrespective of the time t is found as follows:

$$\sin 2\pi x/\lambda=1.$$

Therefore, $$2\pi x/\lambda=\pm(2n-1)\pi/2.$$

Considering only the positive part of the x-coordinate, it is x=(2n−1)λ/4, where n is a positive integer.

Since the resonance state occurs only when the distance between the points where the amplitude is the maximum all the time is the same as a length L of the resonance box, substituting x=L in the above formula, and obtain $$L=(2n-1)\lambda/4.$$

Here, since λ=V/f $$L=(2n-1)V/4f,$$

$$\therefore f=(2n-1)/V/4L \qquad \text{(Formula 2)}$$

is true.

As described above, the resonance of the one-end closed pipe occurs when the length of the resonance box is (2n−1) times as long as one-fourth wavelength. Here, n is a positive integer. FIG. 1(*b*1) shows the state of primary resonance (n=1), while FIG. 1(*b*2) shows the state of secondary resonance (n=2).

The length of external auditory canal 8 is approximately 25 to 30 mm. That is, supposing that the sound speed at 15 degrees Celsius is 340 m/s and the length of the resonance box is 25 to 30 mm, a resonance frequency $f_1$ of the primary resonance (n=1) shown in FIG. 1(*b*1) is found from the formula 2 as follows:

$$f_1 = V/4L \cong 2833 \text{ to } 3400 \text{ (Hz)}.$$

A resonance frequency $f_2$ of the secondary resonance (n=2) is $$f_2 = 3V/4L \cong 8500 \text{ to } 10200 \text{ (Hz)}.$$

A sound pressure-frequency characteristic obtained at the closed end, that is, at the eardrum position when the sound wave with a constant size is incident from an opening end of the resonance box by changing the frequency is shown by a graph in FIG. 2. Theoretically, since resonance occurs only at the resonance frequency, the sound pressure-frequency characteristic shows a sharp peak, but actually, the characteristic as distributed before and after that frequency is obtained.

Therefore, the sound pressure-frequency characteristics at the eardrum position are subjected to the influence of the one-end closed pipe resonance in the external auditory canal and have peaks at 2.8 to 3.4 kHz and at 8.5 to 10.2 kHz as illustrated in FIG. 2. That is, when the earphone is not attached, the eardrum hears sound in the outside world through an acoustic filter having the frequency characteristics illustrated in FIG. 2, and the reception sensitivity of the eardrum can be considered to have a frequency characteristic that the sound having the characteristics in FIG. 2 is heard flat when it is inputted. That is, it is the characteristics vertically reversed in the vertical axis direction in FIG. 2.

However, since the sound-isolating earphone 10 has the earplug structure having the ear pad 5, when the sound-isolating earphone 10 is attached as shown in FIG. 3(*a*), the earphone blocks the external auditory canal entrance 7 and changes the resonance mode. That is, the one-end closed pipe resonance changes to both-end closed pipe resonance with the both ends closed using the external auditory canal 8 as a resonance box.

FIG. 4 shows an internal structure of the sound-isolating earphone 10. As illustrated in FIG. 4, inside the earphone is constituted by an electro-acoustic transducer 2, a sound emitting port 15 which emits a sound wave to the external auditory canal entrance 7, and a sound leading portion 4 which connects the electro-acoustic transducer 2 and the sound emitting port 15. The electro-acoustic transducer 2 is protected by an external housing 1 and fixed to the external housing 1 by a suitable method, not shown.

The electro-acoustic transducer 2 is formed of a coil 21, a permanent magnet 22, and a diaphragm 23. The diaphragm is made of a thin plate of magnetic metal. By applying a current having an acoustic waveform to the coil, the diaphragm 23 vibrates in compliance with the acoustic waveform, and a sound wave is emitted toward the sound leading portion 4 in the direction to the right in FIG. 4. The rear face of the diaphragm 23, which is a sound emitting portion, is sealed.

As shown in FIG. 3, the sectional area of this sound emitting port 15 is smaller than the sectional area of the external auditory canal 8, and thus, reflection of the sound wave in the external auditory canal 8, which causes the standing wave, occurs on the end faces of the sound emitting port 15 and the ear pad 5 substantially without entering the sound leading portion 4. Therefore, the size, that is, the length in the depth direction of the external auditory canal 8 as the resonance box when the sound-isolating earphone is attached is determined by a position where the eardrum 9, the ear pad 5, and the sound emitting port 15 block the external auditory canal 8.

Actually, the position where the ear pad 5, and the sound emitting port 15 block the external auditory canal is slightly changed depending on the insertion condition of the earphone, but as shown in FIG. 3, it is assumed to be substantially equal to the position of the external auditory canal entrance 7, that is, it has the same pipe length as the case of the one-ended closed pipe. The actual length of the both-end closed pipe is also slightly different from the case of the one-end closed pipe, but the above assumption is made to facilitate the analysis.

FIG. 3(*b*1) and FIG. 3(*b*2) are explanatory diagrams of both-end closed pipe resonance and schematically illustrate the state in which the both-end closed pipe resonance occurs. A solid line indicates the both-end closed pipe and a broken line indicates amplitude of air vibration. In the both-end closed pipe resonance state in which the standing wave occurs, the amplitude of air at the positions of the ear drum 9, which is a pipe end, and the ear pad 5 inserted into the external auditory canal entrance 7 becomes the minimum (the pressure change is the maximum), and the air vibration at the position in the middle between the ear drum 9 and the ear pad 5 becomes the maximum (the pressure change is the minimum).

The resonance of the both-end closed pipe becomes the standing wave when the length of the pipe is the wavelength of n times as long as the half wavelength. Here, n is a positive integer. FIG. 3(*b*1) shows the case of the primary resonance (n=1), while FIG. 3(*b*2) shows the case of the secondary resonance (n=2).

As shown in FIG. 3(*b*1), if the pipe length of the both-end closed pipe is 25 to 30 mm, the standing wave having this length as the half wavelength becomes a resonance wave, and supposing that the sound speed at 15 degrees Celsius is 340 m/s, a resonance frequency $f_1'$ of the primary resonance (n=1) is 5.7 to 6.8 kHz. Also, as shown in FIG. 3(*b*2), the secondary resonance (n=2) becomes the standing wave having the pipe length of 25 to 30 mm as 1 wavelength, and thus, a resonance frequency $f_2'$ at that time is 11.3 to 13.6 kHz.

FIG. 5 shows the sound pressure-frequency characteristics at the eardrum position of the sound-isolating earphone. When the earphone is not attached, it becomes the resonance mode of the one-end closed pipe. The sound pressure-frequency characteristics assuming that the sound having a flat frequency characteristic equal to the sound source of the earphone is supplied to the external auditory canal entrance 7 is indicated by a broken line. When the earphone is attached, the characteristic becomes the resonance mode of the both-end closed pipe, and the sound pressure-frequency characteristic at the eardrum position in that case is indicated by a solid line. As shown in this figure, the sound pressure at the eardrum position when the earphone is not attached has peaks at 2.8 to 3.4 kHz and at 8.5 to 10.2 kHz, but the sound pressure peak at the eardrum position when the earphone is attached is subjected to the influence of the closed-pipe resonance in the external auditory canal and is displaced to 5.7 to 6.8 kHz and to 11.3 to 13.6 kHz, respectively.

The reception sensitivity characteristics of the human auditory system is such that the sound of any frequency is heard flat when sound with the frequency characteristics shown in FIG. 2 is inputted to the eardrum. As shown in FIG. 2, the sound around 3 kHz which is emphasized by resonance of the one-end closed pipe of the external auditory canal 8, and which constitutes a peak when the earphone is not attached changes to both-end closed pipe resonance mode when the sound-isolating earphone is attached, and does not constitute a peak around 3 kHz as indicated by a solid line in FIG. 5. Thus, the sound around 3 kHz is heard weaker than it actually is.

Also, since the sound around 6 kHz is emphasized by the both-end closed pipe resonance mode as indicated by the solid line in FIG. 5 when the sound-isolating earphone is attached, there is a problem that a quasi-sonant state occurs, and it sounds like an echo.

In order to solve this problem, as a general method, the frequency characteristic can be corrected by an electric method, but for that purpose, an amplifier and a filter circuit exclusive for the sound-isolating earphone need to be added, which complicates the circuit and requires a power supply. Reduction in size, weight and price cannot be realized easily with the earphone including such circuit. In order to realize reduction of size and price, a method of realizing a desired frequency characteristic only by an electric filter circuit can be considered, but if an amplifier is not included, lowering of the sound volume cannot be avoided.

In order to avoid difficulty of adding an electric circuit, some technologies to solve the problems unique to this sound-isolating earphone with a non-electric method have been proposed. As one of such examples, a technology of placing an acoustic resistor (damper) in a sound path and a technology of changing the length or an opening area of the sound path are disclosed (Patent Literature 1, Patent Literature 2).

According to the technology of Patent Literature 1, it is proposed that an acoustic resistor (damper) 6 is interchangeably installed in the middle of the sound path from an electro-acoustic transducer 2 inside the earphone to the sound emitting port 15 which leads the sound wave to the external auditory canal via the cylindrical sound leading portion 4 so as to adjust the sound quality of the earphone to preference of a user as means for suppressing high-frequency acoustics, which constitutes a problem.

FIG. 6 shows a sectional view of the earphone having the acoustic resistor 6. This is a general structure of an earphone having the acoustic resistor 6, and as the acoustic resistor 6, an unwoven cloth or a thin piece of foamed urethane is used.

FIG. 7 is a graph illustrating the sound pressure-frequency characteristics of the earphone having the acoustic resistor 6. A broken line indicates a characteristic when a sound-isolating earphone not having the acoustic resistor 6 is attached, while a solid line indicates a characteristic when the acoustic resistor 6 is provided for comparison. By referring to the sound pressure-frequency characteristic as the result of attachment of the sound resistor 6 as described above, it is understood that the peak around 6 kHz is suppressed.

Also, Patent Literature 2 proposes an adjustment pipe which can be detachably attached to the inside of an acoustic pipe installed on the side opposite to the sound-wave emitting direction and having different conditions with a different material or length and a method of providing a screw with different adjustment holes which can be interchanged for changing the opening area of the sound leading pipe or the acoustic pipe in order to change the frequency characteristics of the sound wave passing through the sound path.

CITATION LITERATURE

Patent Literature

Patent Literature 1: Japanese Utility Model Registration No. 3160779.

Patent Literature 2: Japanese Unexamined Patent Application Publication: 2007-318702.

SUMMARY OF INVENTION

Technical Problem

With the method using the acoustic resistor (damper) as disclosed in Patent Literature 1, as shown in FIG. 7, the peak around 6 kHz is certainly suppressed in general and echoing sound is eliminated, but since the sound pressure is reduced over the entire sound range, the following problems newly develop.

That is, in FIG. 7, a broken line indicates the sound pressure-frequency characteristics at the eardrum position when a sound-isolating earphone without any measure is attached, while a solid line indicates the sound pressure-frequency characteristics when a sound-isolating earphone having the acoustic resistor 6 (damper) according to the technology of Patent Literature 1 is attached.

By comparing the two characteristics, with the technology of Patent Literature 1 indicated by the solid line, the sound pressure around 6 kHz is certainly suppressed to the level equal to the case without an earphone, that is, the level in FIG. 2, but since the sound pressure in a high frequency range up to slightly above the vicinity of 10 kHz which affects the sound quality is largely deteriorated, the sound would lose most of the high tones, which is a problem. Moreover, since the sound pressure is lowered over the entire sound range, the sound volume is insufficient as a whole, which is also a problem.

Also, according to the technology disclosed in Patent Literature 2, since a pipe for changing the frequency characteristics becomes extremely long, and a screw with holes are arranged in series, the sound leading pipe becomes extremely long and a feature of a sound-isolating earphone of being compact is extremely damaged, which is a problem.

Solution to Problem

The present invention was made in view of the above problems and has an object to provide a sound-isolating earphone used by inserting a sound emitting portion into an external auditory canal entrance, provided with two independent sound leading pipes having different path lengths as a sound leading portion which transfers a sound wave generated from an electro-acoustic transducer to the external auditory canal entrance so that the two sound waves generated from the electro-acoustic transducer and having passed through the two sound leading pipes are synthesized at the external auditory canal entrance and to suppress the sound pressure of a frequency having a difference in the paths of the two sound leading pipes as a half wavelength.

A basic idea to solve the problems will be described. Here, the signs "<< >>" are assumed to express the frequency characteristics. An earphone sound source refers to the sound outputted from a diaphragm of an electro-acoustic transducer. Also, a <<transfer function of a one-end closed pipe resonance box>> refers to a frequency characteristic of the transfer function using the external auditory canal as the resonance box when the earphone is not attached, and <<transfer function of a both-end closed pipe resonance box>> refers to a frequency characteristic of the transfer function using the external auditory canal as the resonance box when the earphone is attached.

When the earphone is not attached, the following formula holds:

<<Sound pressure applied to the eardrum>>=<<Sound pressure applied to the external auditory canal entrance>>×<<Transfer function of one-end closed pipe resonance box>>.

Also, since the earphone is not attached, the sound pressure applied to the external auditory canal entrance cannot be specified, but in order to facilitate calculation, assuming that a sound pressure equal to the sound pressure of the sound source of the earphone is applied to the external auditory canal entrance, <<Sound pressure applied to the external auditory canal entrance>>=<<Sound pressure of earphone sound source>> is obtained.

Therefore,

<<Sound pressure applied to the eardrum>>=<<Sound pressure of earphone sound source>>×<<Transfer function of one-end closed pipe resonance box>> (Formula 3)

is obtained.

Subsequently, when the sound-isolating earphone is attached, the following formula holds:

<<Sound pressure applied to the eardrum>>=<<Sound pressure applied to external auditory canal entrance>>×<<Transfer function of both-end closed pipe resonance box>>.

And also,

⟨⟨Sound pressure applied to the external auditory canal entrance⟩⟩ =

⟨⟨Sound pressure outputted from the earphone sound emitting port⟩⟩ =

⟨⟨Sound pressure of earphone sound source⟨⟨*x*⟩⟩Transfer function of sound leading portion of sound-isolating earphone⟩⟩is true.

Therefore,

<<Sound pressure applied to the eardrum>>=<<Sound pressure of earphone sound source>>×<<Transfer function of sound leading portion of sound-isolating earphone>>×<<Transfer function of both-end closed pipe resonance box>> (Formula 4)

is obtained.

What is required is that <<Sound pressures applied to the eardrum>> acquired by the formula 3 and the formula 4 become equal, and thus, <<Sound pressure of earphone sound source>>×<<Transfer function of one-end closed pipe resonance box>>=<<Sound pressure of earphone sound source>>×<<Transfer function of sound leading portion of sound-isolating earphone>>×<<Transfer function of both-end closed pipe resonance box>> is obtained.

When this formula is put in order, the following expression is obtained:

<<Transfer function of sound leading portion of sound-isolating earphone>>=<<Transfer function of one-end closed pipe resonance box>>/<<Transfer function of both-end closed pipe resonance box>>. (Formula 5)

According to this formula, the transfer function of the sound leading portion of the sound-isolating earphone on the left side is requested to create the following state. That is, what the numerator on the right side means is that the characteristics of the one-end closed pipe resonance box without attaching the earphone is reproduced in a state in which the sound-isolating earphone is attached. Also, the denominator on the right side means realization of the characteristics which cancels the characteristics of the both-end closed pipe resonance box generated by attachment of the sound-isolating earphone.

The inventor found that the sound quality is substantially improved by realizing the characteristics indicated by the denominator on the right side or particularly by suppressing the sound in which the vicinity of 6 kHz is abnormally emphasized. Also, the inventor found that, by ensuring the entire sound volume, even if the sound pressure around 3 kHz is not reproduced, it is not noticeable since the entire sound volume is ensured in accordance with the characteristics shown by the numerator on the right side.

That is, since the characteristic has become such that a peak is provided around 5.7 to 6.8 kHz due to the both-end closed pipe resonance using the external auditory canal as the resonance box, it is important that the frequency characteristics of the transfer function of the sound leading portion of the sound-isolating earphone suppresses the sound having the frequency with this peak.

The present invention realized the above by using a phenomenon in which sound with a specific frequency is damped when a sound wave passes through two paths with different lengths and then, are synthesized again.

FIG. 8(*a*) is a conceptual diagram of the sound-isolating earphone having two sound leading pipes having different path lengths of the present invention. A first path of the sound wave is a path from the diaphragm 23 of the electro-acoustic transducer 2 inside the earphone to the sound emitting port 15 inserted into the external auditory canal entrance via the linear sound leading pipe 11. A second path of the sound wave is a path similarly from the diaphragm 23 of the electro-acoustic transducer 2 inside the earphone to the sound emitting port 15 via sound leading pipes 12, 13 and 14, which are installed in a U-shape as a bypass of the linear sound leading pipe 11.

The sound wave having entered the sound leading pipe 11 is separated at a P point, which is a branch point, to a sound wave which continuously travels through the sound leading pipe 11 and a sound wave which travels through the sound leading pipe 12. The separated two sound waves pass through the sound leading pipe 11, the sound leading pipes 12, 13, and 14, respectively, merge again with each other at a merging point Q, reaches the sound emitting port 15 and enters the external auditory canal.

FIG. 8(*b*) is a conceptual diagram of a state in which the two sound waves are synthesized. FIG. 8(*b*) shows that the sound from one sound source travels through the two paths separately and if their phases are shifted from each other by 180 degrees at the exit of the paths due to the difference in the length of the paths, for example, the amplitude of the synthesized sound waves becomes zero.

This is expressed below by an expression. Assume that a signal P(ω) of the P point is:

$$P(\omega)=2A\sin\omega t.$$

(Here, ω is an angular speed, t is time, and A is an arbitrary constant.) the signal Q(ω) when the sound is branched uniformly to the two paths at the P point, passes through the respective predetermined paths and is synthesized again at a synthesizing point Q is as follows, when V is a sound speed and L is a difference in the length of the two paths:

$$Q(\omega)=A\sin(\omega t)+A\sin(\omega t+\omega L/V).$$

In this expression, since the waveform is not changed even if an observation point of the waveform is shifted forward only by L/2V on the time axis, $$Q(\omega) = A\sin(\omega t - \omega L/2V) + A\sin(\omega t + \omega L/2V) \quad \text{(Formula 6)}$$
$$= 2A\sin\omega t \times \cos\omega L/2V$$
$$= P(\omega) \times \cos\omega L/2V$$

is obtained.

From the formula 6, a transfer function $T_{PQ}$ of the waveform reaching the Q point from the P point is:

$$T_{PQ} \propto \cos \omega L/2V$$

and thus, the transfer function $T_{PQ}'$ of the sound pressure:

$$T_{PQ}' \propto I \cos \omega L/2VI$$

is obtained. If this expression is rewritten by using $\omega=2\pi f$, $$T_{PQ}' \propto I \cos \pi f L/VI \quad \text{(Formula 7)}$$

is obtained. (Here, f is a frequency.)

FIG. 9 is a transfer function of the sound leading portion of the sound-isolating earphone. The transfer function $T_{PQ}'$ when the sound waves pass through the two paths having a path length difference of 25 to 30 mm (corresponding to the average length of the external auditory canal) with the sound speed of 340 m/s and then, synthesized again (formula 7) is indicated by a solid line. That is, this transfer function corresponds to <<Transfer function of both-end closed pipe resonance box>>$^{-1}$, which is the second term on the right side in the expression which gives <<Transfer function of sound leading portion of sound-isolating earphone>> shown in the formula 5 and acts to suppress the characteristics emphasized by the both-end closed pipe resonance box. That is, in the formula 7, in the case of 2L=V/f (twice the path length difference is equal to the wavelength), the transfer function shows a trough in the frequency characteristics around f=V/2L≅6 kHz.

Moreover, FIG. 9 shows <<Transfer function of both-end closed pipe resonance box>> indicated by the solid line in FIG. 5 by a broken line in a superimposed manner. By synthesizing the solid line <<Transfer function of sound leading portion of ear-isolating earphone) and the broken line <<Transfer function of both-end closed pipe resonance box>> shown in FIG. 9 in accordance with the formula 5, a graph indicated by a solid line in FIG. 10 as <<Sound pressure applied to eardrum>> when the sound-isolating earphone having the plurality of paths of the present invention is attached is obtained. This graph shows the frequency characteristics to be applied to the eardrum when a human being wears the sound-isolating earphone having the U-shaped sound leading pipe shown in the conceptual diagram in FIG. 8 as a bypass.

Moreover, FIG. 10 shows the frequency characteristics of <<Transfer function of both-end closed pipe resonance box>> (the both-end closed pipe resonance characteristics indicated by the solid line in FIG. 5) when a human being wears a simple sound-isolating earphone without any special measure including the technologies proposed in Patent Literatures 1 and 2, indicated by a broken line in a superimposed manner.

By comparing the both characteristics, it is understood that in the sound-isolating earphone having the U-shaped bypass, the sound pressure around 6 kHz is suppressed better than the simple sound-isolating earphone and has a relatively flat characteristic and a peak around 12 kHz in a high-frequency range which might affect the sound quality.

In FIG. 10, in the graph of a solid line indicating the frequency characteristics of the <<Sound pressure applied to eardrum>>, the shape of the graph of the characteristics at the center part around 6 kHz is expressed as projecting upward, but whether the shape of the graph projects upward or downward is actually determined by the design of the sound-isolating earphone or the state of attachment, and the shape itself is not so important.

The important point here is that the large peak around 6 kHz is suppressed by the present invention, and echoing is eliminated. On the other hand, the characteristics of the sound pressure in the high-frequency range up to slightly above the vicinity of 10 kHz, which affects the sound quality, is considerably emphasized, but due to the nature of human ears, even if the sound pressure around here is considerably emphasized, it does not become echoing but is heard as the sound in which only its high tone is emphasized and is not annoying.

Moreover, at the right end in the graph of the high-tone range, the characteristics above the vicinity of 15 kHz is lowered in the end, but this range is originally difficult to be heard by human ears, and it hardly affects the actual sound quality of the earphone.

Advantageous Effects of Invention

That is, lowering of the sound volume of the entire sound range can be prevented while the sound pressure peak in the undesired frequency caused by both-end closed pipe resonance is suppressed, since in the sound-isolating earphone of the present invention used by inserting the sound emitting portion into the external auditory canal entrance, the two independent sound leading pipes having different path lengths are provided as the sound leading portion which transfers the sound wave generated from the electro-acoustic transducer to the external auditory canal so that the two sound waves generated from the electro-acoustic transducer and having passed through the two sound leading pipes are synthesized at the sound emitting port in the vicinity of the external auditory canal entrance, and the sound pressure of the frequency having the path length difference of the two sound leading pipes as the half wavelength and the frequency of the integer times can be suppressed. As a result, such an effect can be obtained that the sound quality hardly different from the case without wearing the earphone can be realized.

DESCRIPTION OF EMBODIMENTS

A sound-isolating earphone according to the present invention will be described below by referring to an embodiment.

Embodiment 1

A first embodiment is a sound-isolating earphone used by inserting a sound emitting portion into an external auditory canal entrance, characterized by including two independent sound leading pipes having different path lengths as a sound leading portion which transfers a sound wave generated from an electro-acoustic transducer to the external auditory canal entrance so that two sound waves generated from the electro-acoustic transducer and having passed through the two sound leading pipes are synthesized at the external auditory canal entrance, the sound pressure of a frequency having the path length difference of the two sound leading pipes as a half wavelength is suppressed, and the path length difference of the two sound leading pipes is equal to an interval between the external auditory canal entrance and an eardrum in the depth of the external auditory canal.

Moreover, this embodiment is a sound-isolating earphone characterized in that the sound leading portion which transfers the sound wave generated from the electro-acoustic transducer to the external auditory canal entrance is formed of a double cylindrical member, a helical groove is formed in an outer periphery of a second cylindrical member fitted in the inside of a first cylindrical member on the outside, and a first sound leading pipe, which is a linear path forming an inner peripheral face of the second cylindrical member, and a second sound leading pipe, which is a path constituted by an inner peripheral face of the first cylindrical member and the helical groove formed in an outer periphery of the second cylindrical member are provided.

Figure 11:
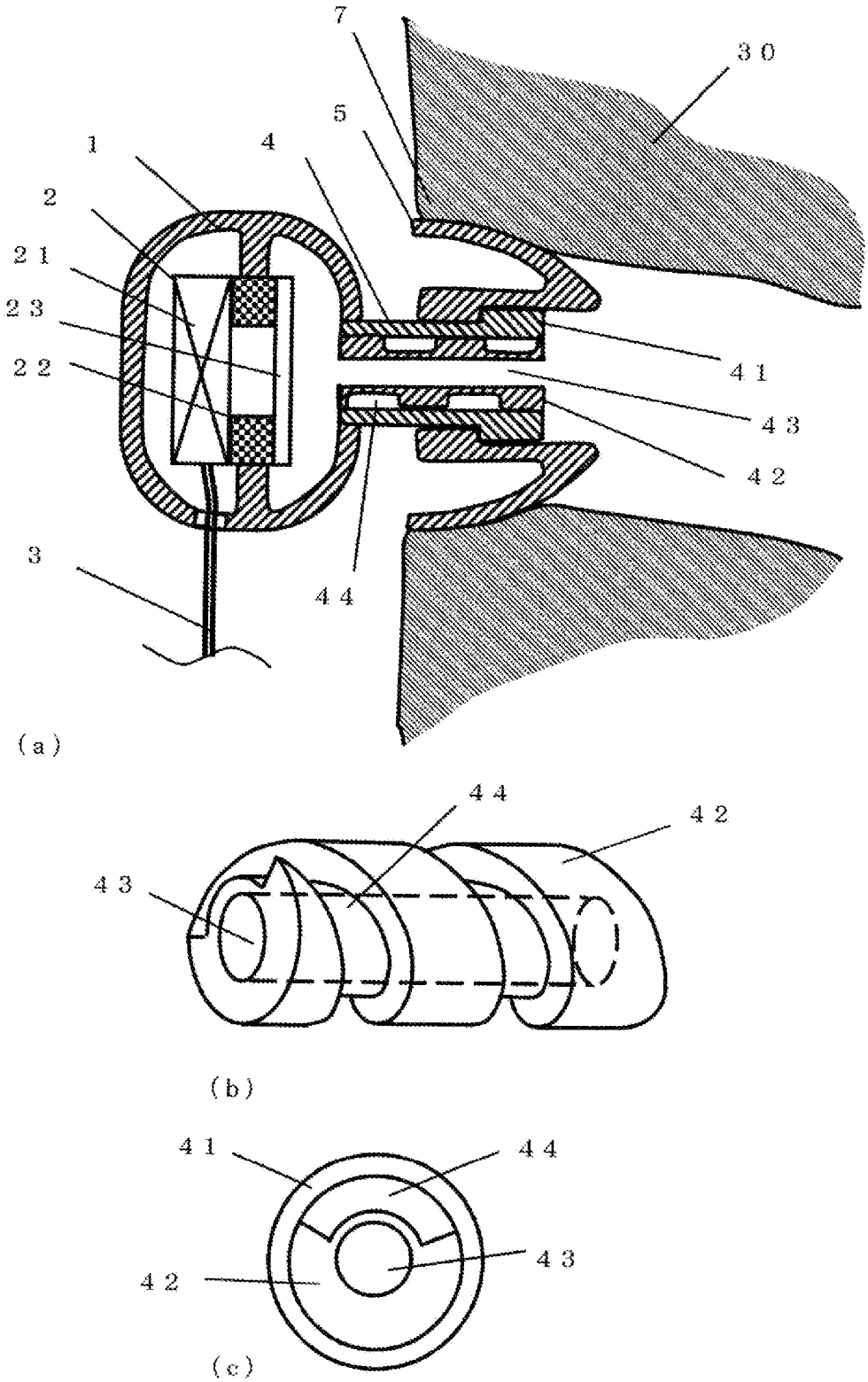
FIG. 11 are sectional views of a sound-isolating earphone provided with a sound leading portion formed of a double cylindrical member.

The first embodiment will be described by referring to FIG. 11. FIG. 11(*a*) is a sectional view of the sound-isolating earphone provided with the sound leading portion formed by the double cylindrical member. FIG. 11(*b*) is a schematic diagram of a cylindrical member 42 having a helical groove. FIG. 11(*c*) is a front view of a sound leading portion 4.

As illustrated in FIG. 11(*a*), the sound-isolating earphone is formed of an electro-acoustic transducer 2 installed inside an external housing 1, a lead wire 3 which connects the electro-acoustic transducer 2 to an external amplifier or the like, the sound leading portion 4 which transfers a sound wave generated by the electro-acoustic transducer 2 to the external auditory canal, and an ear pad 5 which becomes a cushion when being inserted into the external auditory canal and shuts off noises from the outside at the same time.

The sound leading portion 4 is fixed to the external housing 1 by an appropriate method, not shown. The ear pad 5 is inserted into the sound leading portion 4 over a projection formed at the distal end portion of the sound leading portion 4 by using its elasticity and is fixed. The ear pad 5 can be replaced as appropriate.

Figure 1:
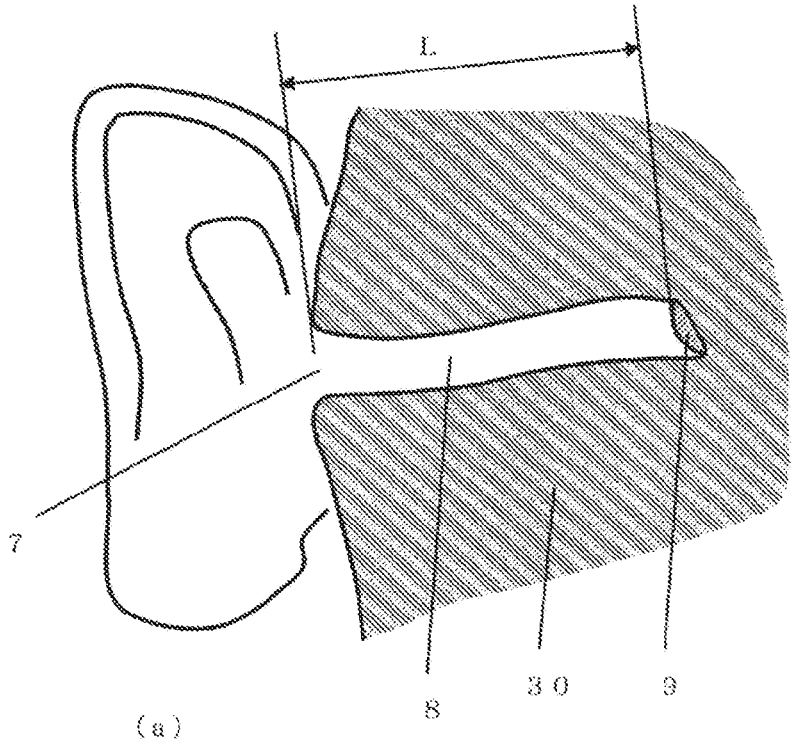
FIG. 1 (Prior Art)
FIG. 1 are schematic views of an external auditory canal (prior art).
Figure 1:
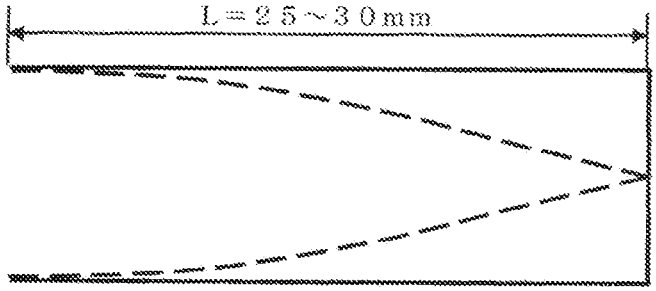
FIG. 1 (Prior Art)
Figure 1:
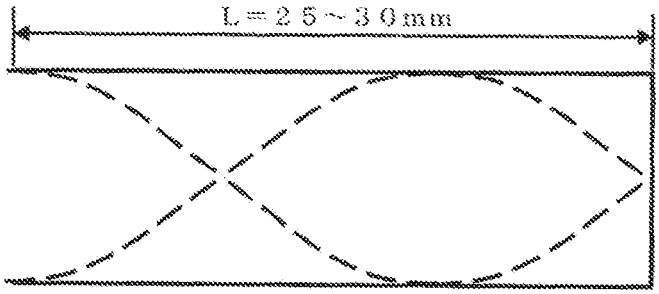
FIG. 1 (Prior Art)
Figure 2:
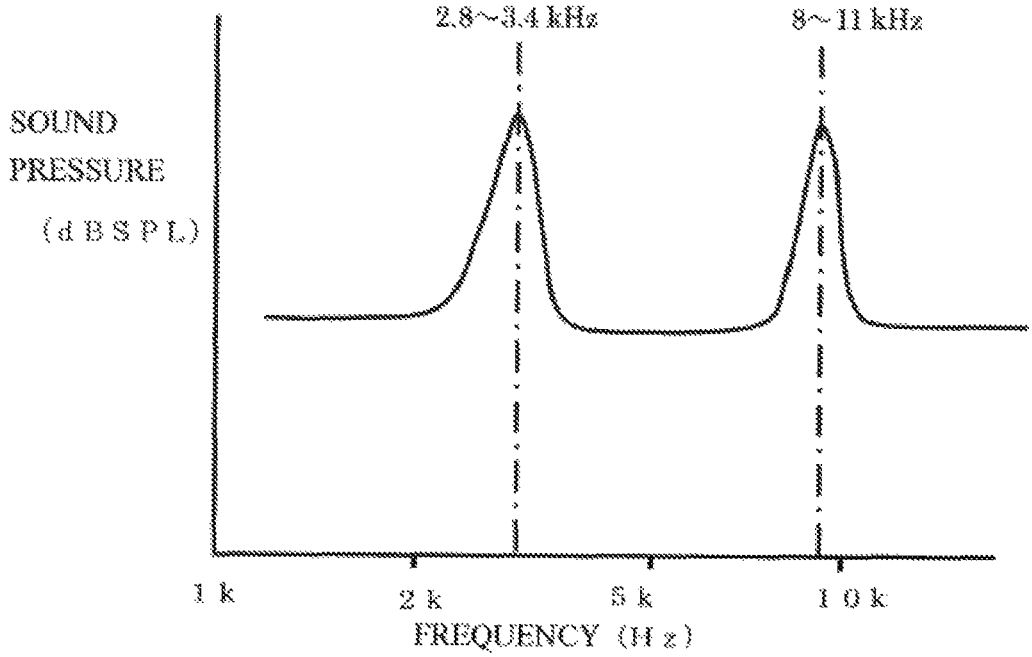
FIG. 2(Prior Art)
FIG. 2 is a sound pressure-frequency characteristic at an eardrum position (prior art).
Figure 3:
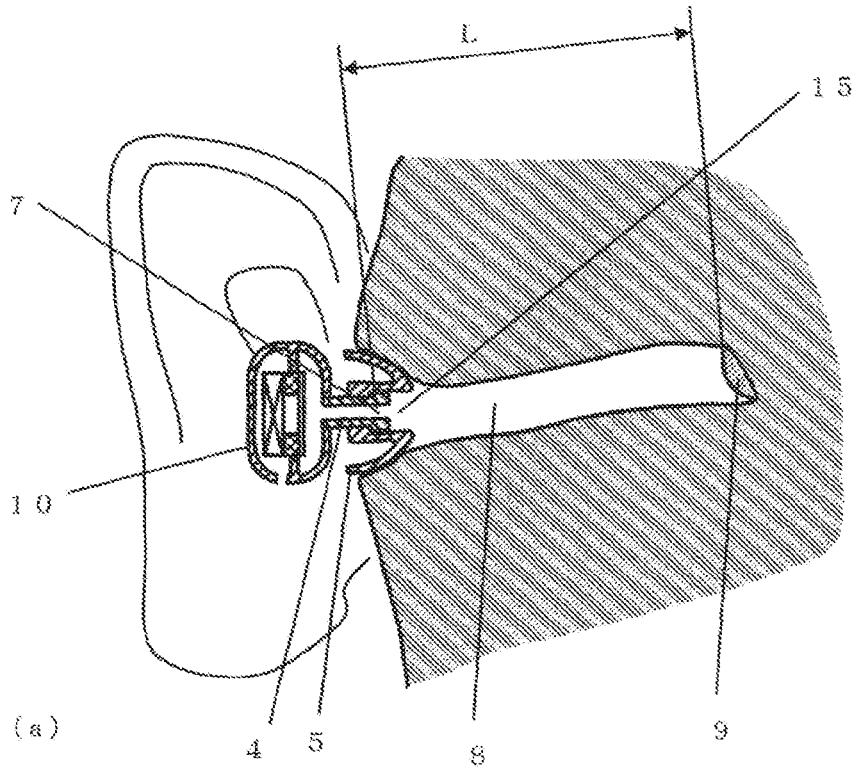
FIG. 3(Prior Art)
FIG. 3 are diagrams illustrating a sound-isolating earphone when attached (prior art).
Figure 3:
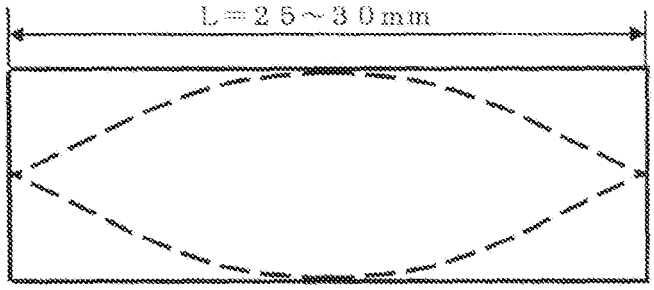
FIG. 3(Prior Art)
Figure 3:
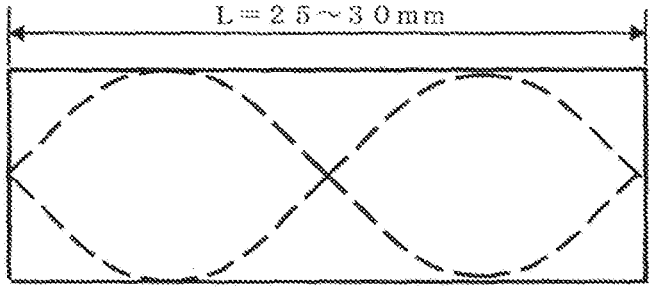
FIG. 3(Prior Art)
Figure 4:
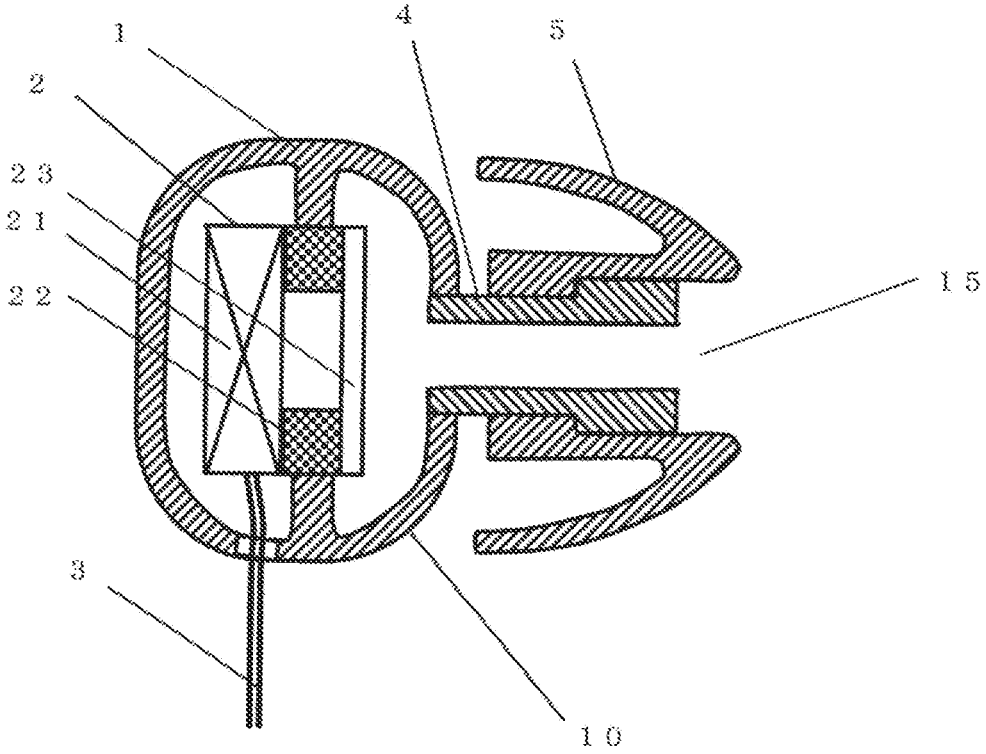
FIG. 4(Prior Art)
FIG. 4 is a schematic diagram illustrating an internal structure of the sound-isolating earphone (prior art).
Figure 5:
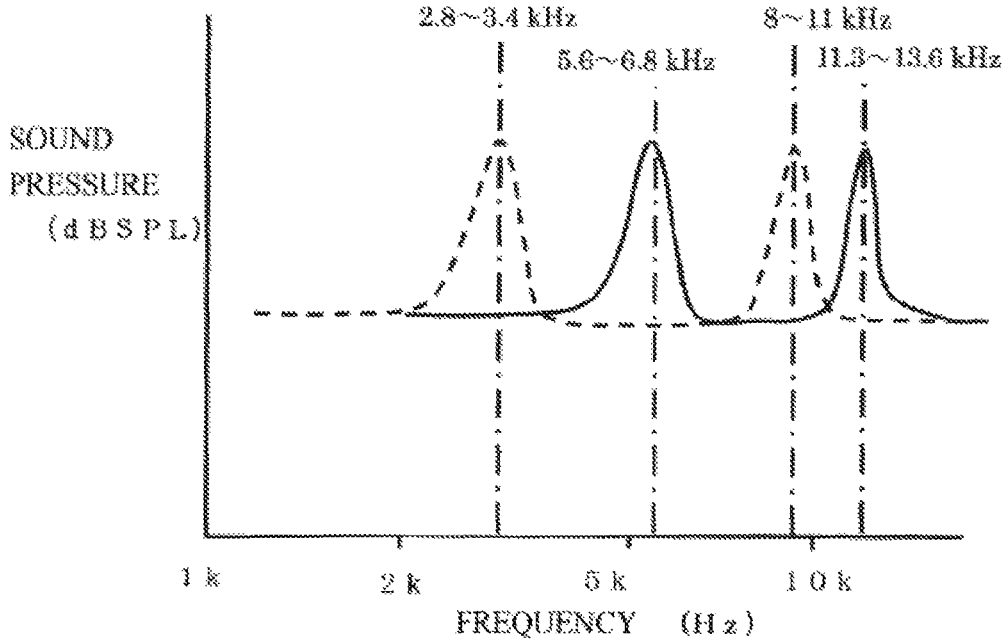
FIG. 5(Prior Art)
FIG. 5 is a sound pressure-frequency characteristic at the eardrum position of the sound-isolating earphone (prior art).
Figure 6:
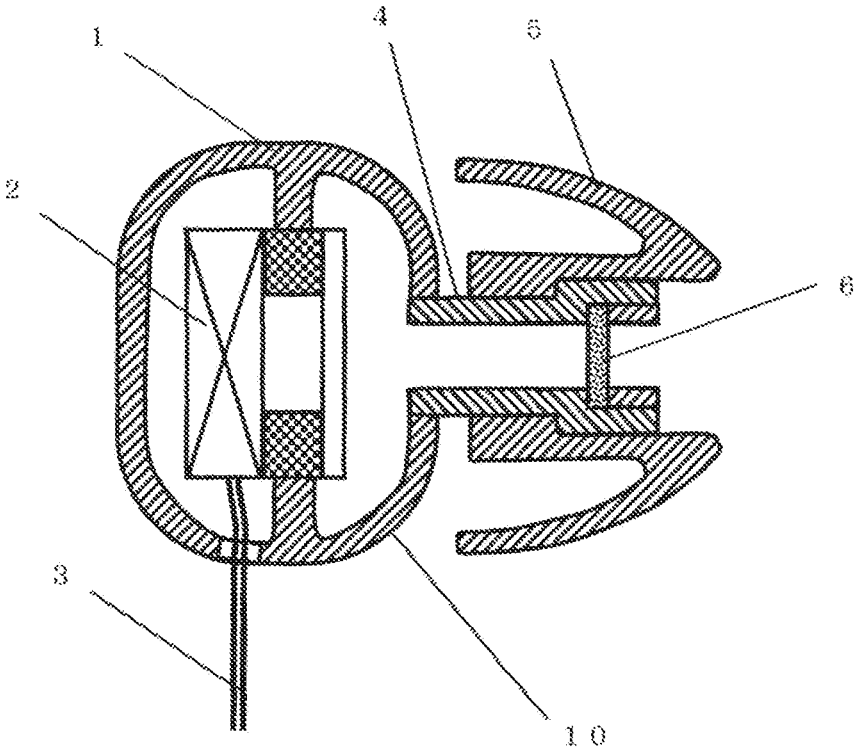
F I G. 6 (Prior Art)
FIG. 6 is a sectional view of an earphone having an acoustic resistor (prior art).
Figure 7:
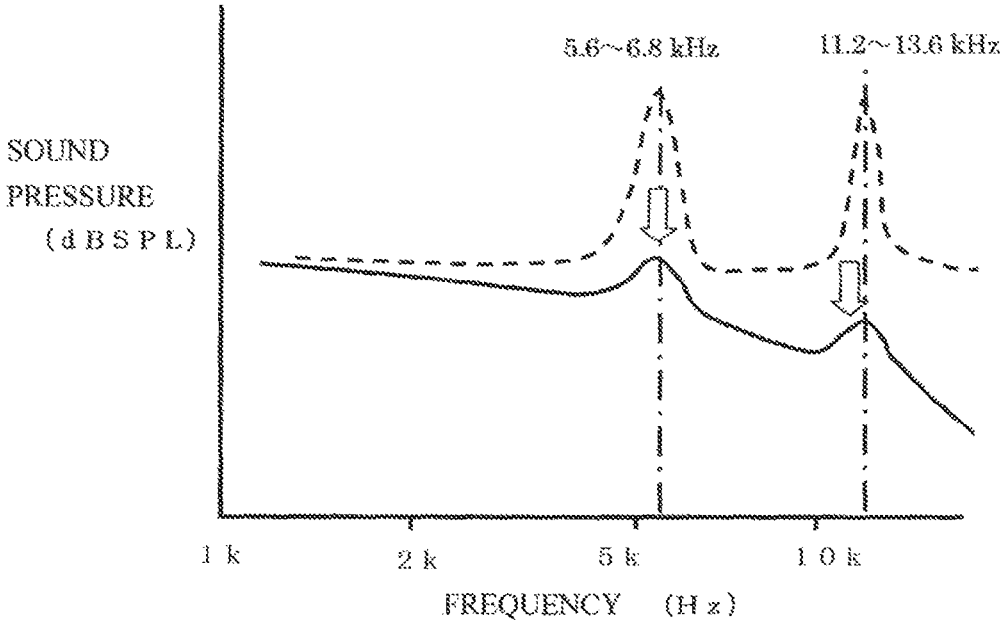
FIG. 7 (Prior Art)
FIG. 7 is the sound pressure-frequency characteristic when the earphone having the acoustic resistor is attached (prior art).
Figure 8:
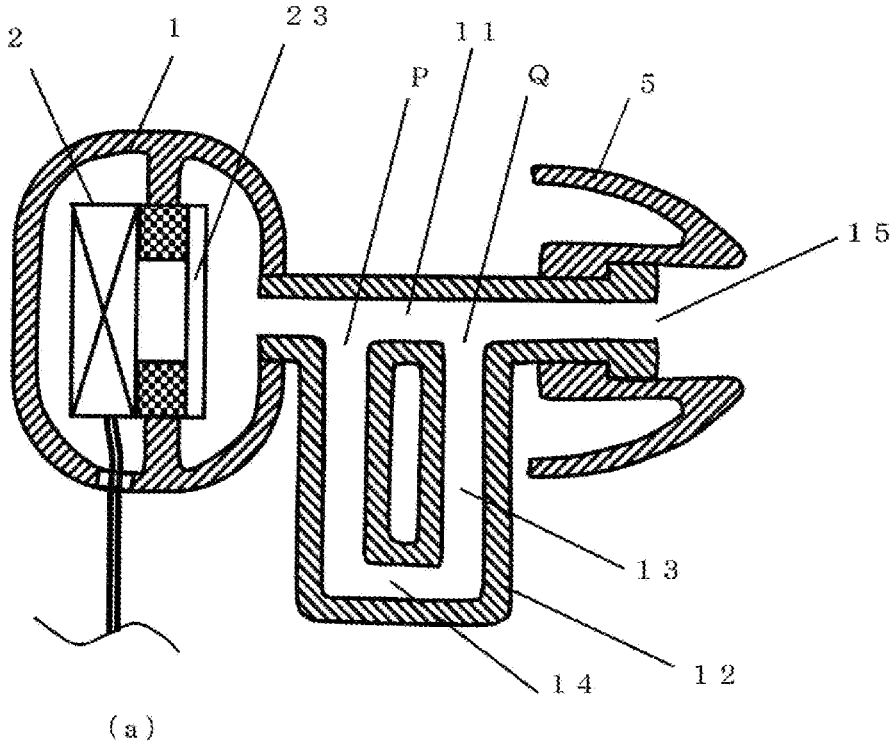
FIG. 8 are conceptual diagrams illustrating a bypass path of a sound leading pipe.
Figure 8:
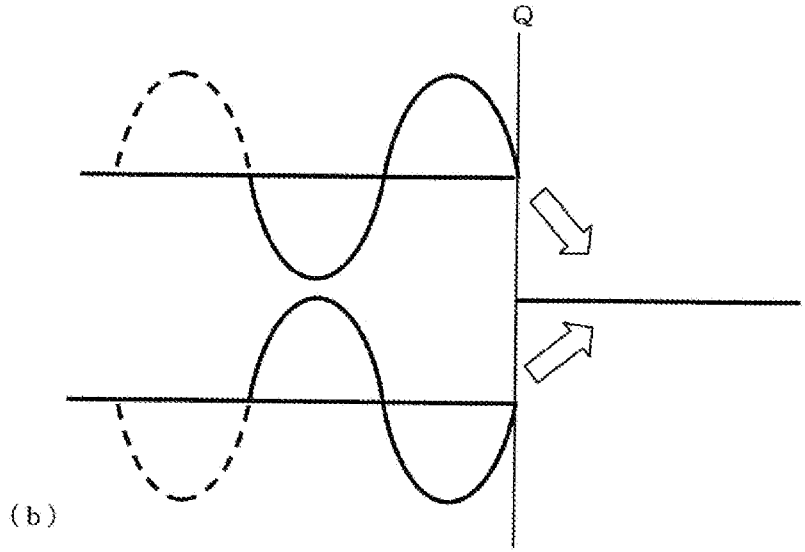
Figure 9:
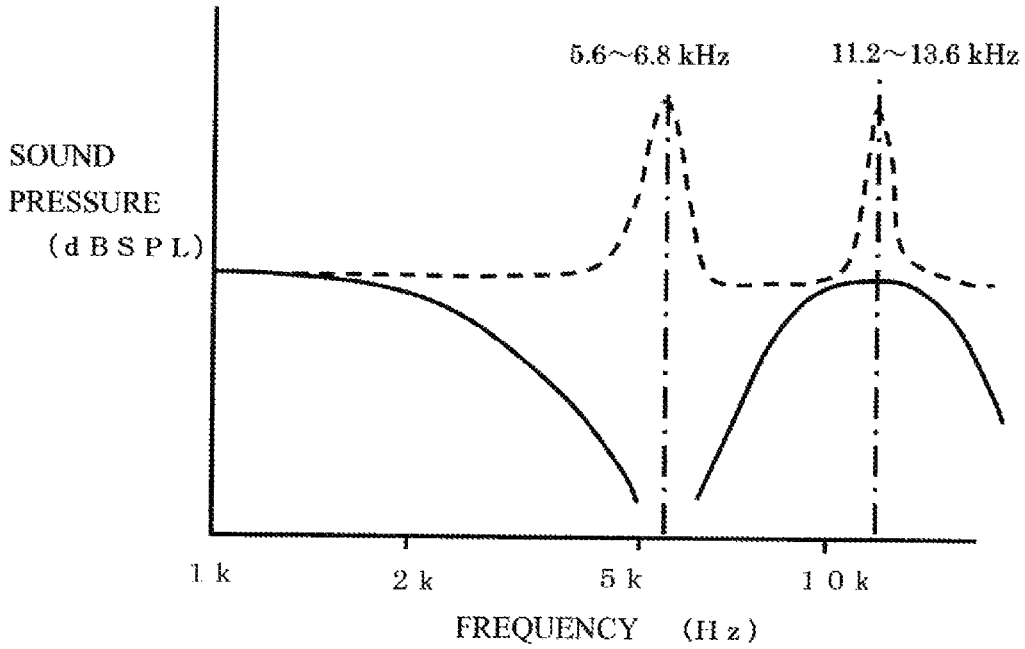
FIG. 9 is a transfer function of the sound leading portion of the sound-isolating earphone.
Figure 10:
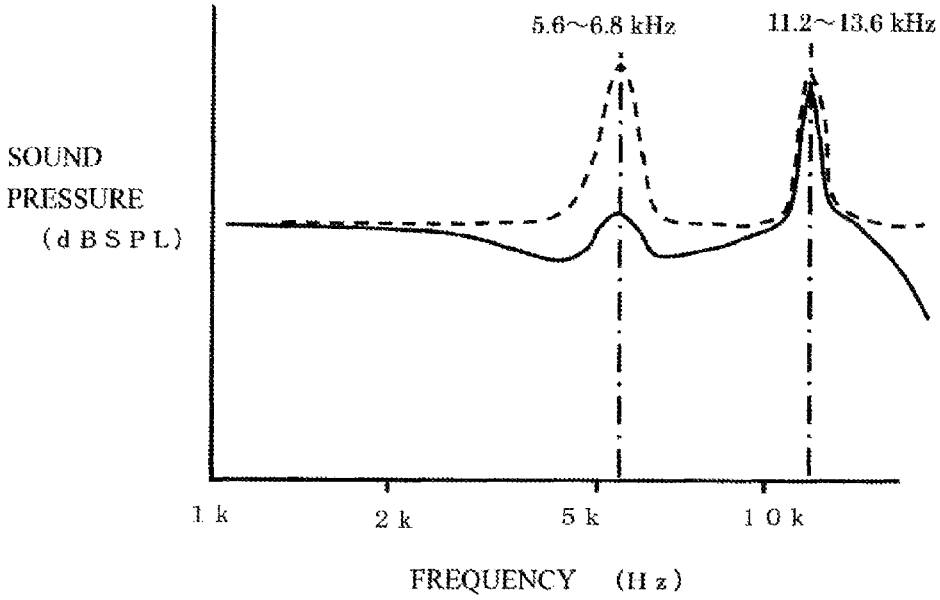
FIG. 10 is the sound pressure-frequency characteristic of the sound-isolating earphone having a bypass path.

In the prior-art sound-isolating earphone shown in FIG. 4, the sound leading pipe which leads the sound wave to the external auditory canal from the electro-acoustic transducer 2 inside the earphone is a simple pipe. The sound leading portion 4 in this embodiment shown in FIG. 11(*a*) is formed of the double cylindrical member, that is, a first cylindrical member 41 on the outside and a second cylindrical member 42 on the inside. The outer diameter of the second cylindrical member 42 is equal to the inner diameter of the first cylindrical member 41, and they are configured such that the second cylindrical member 42 fits perfectly in the inside of the first cylindrical member 41.

The external housing 1 is made by molding hard plastic or the like. The cylindrical member 41 and the cylindrical member 42 are made by molding or cutting hard plastic, metal, or the like. The ear pad 5 is made by molding soft plastic or rubber.

The electro-acoustic transducer 2 is fixed to the external housing 1 by an appropriate method, not shown. The electro-acoustic transducer 2 is formed of a coil 21, the permanent magnet 22, and the diaphragm 23. The diaphragm is made of a thin plate of magnetic metal. By applying a current having an acoustic waveform to the coil, the diaphragm vibrates in compliance with the acoustic waveform, and a sound wave is emitted toward the sound leading portion 4 in the direction to the right in FIG. 11(*a*).

As shown in FIG. 11(*a*) and FIG. 11(*b*), a linear hole 43 at the center of the second cylindrical member 42 is a first sound leading pipe 43.

Similarly, as shown in FIG. 11(*b*), helical groove 44 is formed in the outer peripheral face of the second cylindrical member 42. By inserting the second cylindrical member 42 into the hole in the first cylindrical member 41 as shown in FIG. 11(*c*), a second sound leading pipe 44 is composed of the inner peripheral face of the first cylindrical member 41 and the helical groove 44 formed in the outer periphery of the second cylindrical member 42. The sound waves enter and pass through these two sound leading pipes, respectively.

Since this second sound leading pipe 44 has a helical shape, the length of the passage is longer than the length of the second cylindrical member 42. When the sound waves pass through the two sound leading pipes with different whole lengths independently and merge with each other at the exit, the air vibration is offset by the frequency at which the difference in the path lengths becomes a half wavelength. As a result, the sound waves are damped, and a trough is generated at the position of the frequency in the frequency characteristics.

The fact that a required numerical value can be realized in this embodiment will be shown below. Since a wavelength $\lambda_t$ of the sound wave with 6 kHz, which is the frequency to be damped, has the speed of sound at approximately 340 m/s at 15° C., $$\begin{aligned}\lambda_t &= \text{sound speed}/\text{frequency}\\ &= 340\ (\text{m/s})/6000\ (1/\text{s})\\ &\cong 0.0566\ (\text{m})\end{aligned}$$

is obtained.

In FIG. 11(*a*), the length of the path through the linear first sound leading pipe 43 is the length of the cylindrical member 42. This is assumed to be L mm. The length of the path through the helical second sound leading pipe 44 should be the length obtained by adding L to the half-length of the wavelength acquired by calculation, which is 28.3 mm.

Assume that the length of the cylindrical member 42 is L mm, the diameter is D mm, the depth of the helical groove 44 is S mm, and the number of helical turns is m times. Using the position at the half depth of the depth of the helical groove 44 as the reference of the diameter of the helix, the length of the second sound leading pipe 44 can be expressed by the following expression:

$$\text{The length of the second sound leading pipe:}=[\{m\times\pi\times(D-S)\}^2+L^2]^{1/2}\ (\text{mm}).$$

Since the length of the first sound leading pipe 43 is L (mm), which is equal to the length of the second cylindrical member 42, assuming that the difference in length between the first sound leading pipe 43 and the second sound leading pipe 44 is ΔL, $$\Delta L=[\{m\times\pi\times(D-S)\}^2+L^2]^{1/2}-L\ (\text{mm}).$$

is obtained.

In the sound-isolating earphone, the dimensions of L=10 (mm), D=5 (mm), and S=1 (mm), for example, are appropriate as the dimension to be worn by a human body 30. At this time, the number of helical turns so as to obtain the ΔL value of 28.3 mm is found by using the formula 8:

$$28.3=[\{m\times\pi\times(5-1)\}^2 30\ 10]^{1/2}-10\approx(158\ m^2+10^2)-10$$

Consequently, $$158\ m^2+10^2=(28.3+10)^2.$$

From the mathematical formula described above, m≈2.9 (times) is obtained. This is a value which can be easily realized by a plastic material or the like.

The length of the sound leading portion 4 shown in this embodiment was set to 10 mm, but if the shorter sound leading portion 4 is to be used in practice, it is only necessary to increase the number of helical turns from 2.9 times in accordance with the length of the sound leading portion 4.

Consequently, the difference in length between the path through the first sound leading pipe 43 and the path through the second sound leading pipe 44 becomes a half wavelength, a trough is generated at the position around the frequency of 6 kHz in the frequency characteristics, and the sound waves can be damped.

Figure 15:
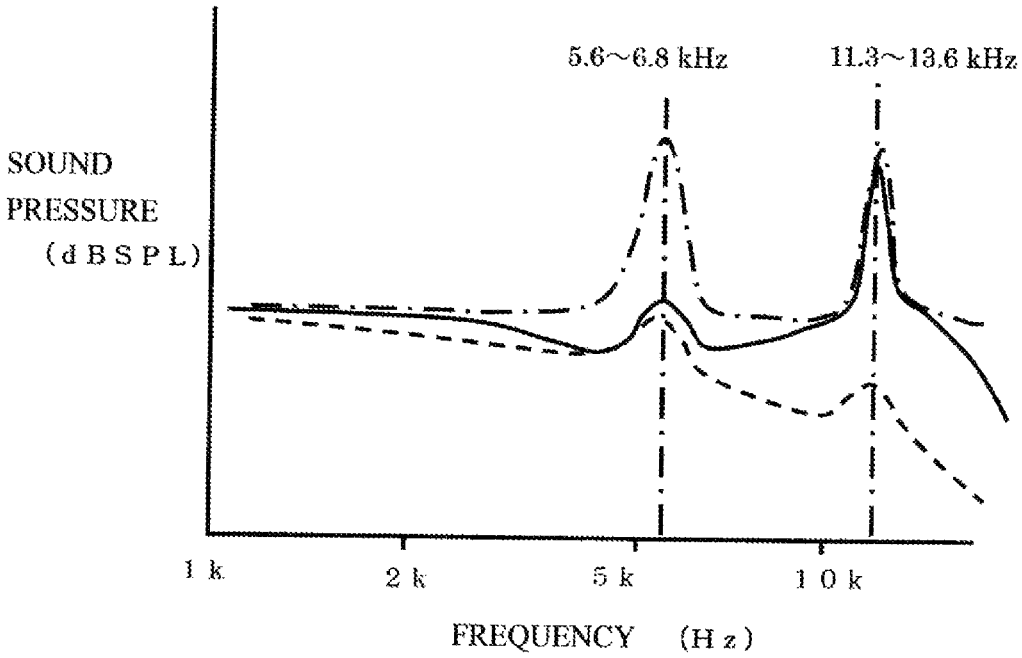
FIG. 15 is the sound pressure-frequency characteristic of each method at the eardrum position.

FIG. 15 shows sound pressure-frequency characteristics at the eardrum position in each method. In FIG. 15, the frequency characteristics of the sound pressure applied to the eardrum when a human being wears a simple sound-isolating earphone without any special measure is indicated by a one-dot chain line, the case in which the sound-isolating earphone having the acoustic resistor installed is attached is indicated by a broken line, and the case in which the sound-isolating earphone having the sound leading portion according to the present invention is attached is indicated by a solid line in a superimposed manner.

When the sound-isolating earphone according to the present invention is attached, occurrence of a peak around 6 kHz in the frequency characteristics of the sound pressure when the simple sound-isolating earphone is attached does not occur any longer, and deterioration in sensitivity in the high frequency range up to slightly above the vicinity of 10 kHz if the acoustic resistor is applied and deterioration in sensitivity in the whole range is improved.

Embodiment 2

A second embodiment is a sound-isolating earphone used by inserting the sound emitting portion into the external auditory canal entrance, characterized by including two independent sound leading pipes having different path lengths as a sound leading portion which transfers a sound wave generated from an electro-acoustic transducer to the external auditory canal entrance so that two sound waves generated from the electro-acoustic transducer and having passed through the two sound leading pipes are synthesized at the external auditory canal entrance, the sound pressure of a frequency having the path length difference of the two sound leading pipes as a half wavelength is suppressed, and in the sound leading portion which transfers the sound waves generated from the electro-acoustic transducer to the external auditory canal entrance, a first sound leading pipe which connects the electro-acoustic transducer and the external auditory canal entrance to each other by a linear path and a second sound leading pipe which connects the electro-acoustic transducer and the external auditory canal entrance to each other by a folded path are provided.

Figure 12:
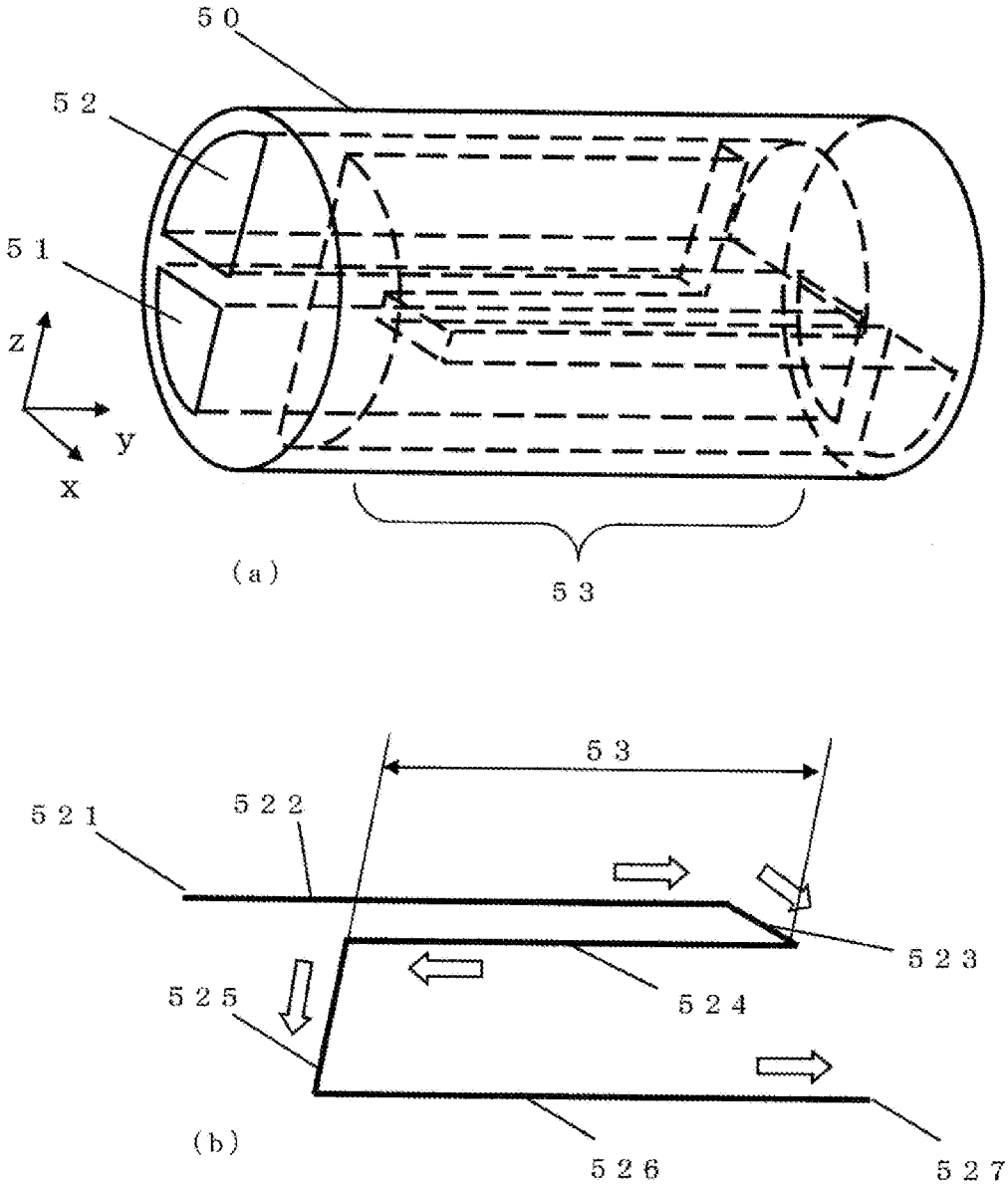
FIG. 12 are schematic diagrams of the sound leading portion in which a folded type sound leading pipe is installed.

The second embodiment will be described by referring to FIG. 12. FIG. 12(*a*) is a schematic diagram of the sound leading portion in which a folded sound leading pipe is installed. FIG. 12(*b*) is a schematic diagram illustrating a virtual line passing through the center of the sound leading pipe 52.

The structure of the sound-isolating earphone of this embodiment is the same as that of the embodiment 1 other than the sound leading portion 50. The two sound leading pipes having a difference in the whole lengths are realized by a combination of the first linear sound leading pipe 51 and the second sound leading pipe 52 having a folded path.

FIG. 12(*a*) is a diagram for explaining the structure of the sound leading portion 50 and shows an example in which the sound leading pipe 52 is folded twice. The sound leading pipe 51 enters the columnar sound leading portion 50 from the front on the left side, advances linearly therethrough and penetrates to the rear face on the right side.

The sound leading pipe 52 enters the sound leading portion 50 from the front on the left side, is folded twice inside the sound leading portion 50 without penetrating the right and left fronts, the rear or the sides, and finally penetrates to the rear face on the right side.

Since the sound leading pipe 52 has a complicated structure, the folded structure will be described in detail by referring to FIG. 12(*b*). In the following explanation, the three-dimensional orthogonal coordinates shown at the left end in FIG. 12(*a*) are used as a reference. The coordinate axes are common to all the explanation using FIG. 12. The xz plane made by the coordinate axes is in parallel with the front face and the rear face of the columnar sound leading portion 50, and the y-axis is in parallel with the longitudinal direction of the sound leading portion 50 and passes through the center of the sound leading portion 50.

In FIG. 12(*b*), all the peripheral objects are removed and only a virtual line passing through the center of the sound leading pipe 52 is shown to facilitate understanding. The sound leading pipe 52 starts at an entrance 521 located at the front on the left side of the columnar sound leading portion 50 and then, advances through an entrance-side straight path 522 in the positive direction of the y-axis.

Subsequently, the sound leading pipe 52 bends in the x-axis direction at the position before penetrating the rear face on the right side in the figure of the sound leading portion 50 and advances through a lateral path 523 in the positive direction of the x-axis. Then, the sound leading pipe 52 bends again in the y-axis direction at the position before penetrating the side face on the front in the figure of the column of the sound leading portion 50 and advances through a return path 524 in the negative direction of the y-axis.

Subsequently, the sound leading pipe 52 bends in the z-axis direction at the position before penetrating the front on the left side of the figure of the sound leading portion 50 and advances through a vertical path 525 in the negative direction of the z-axis. Subsequently, the sound leading pipe 52 bends again in the y-axis direction at the position before penetrating the side face below the figure of the sound leading portion 50 and advances through an exit-side straight path 526 in the positive direction of the y-axis. The pipe advances as it is so as to penetrate the rear face on the right side and ends by reaching an exit 527.

Figure 13:
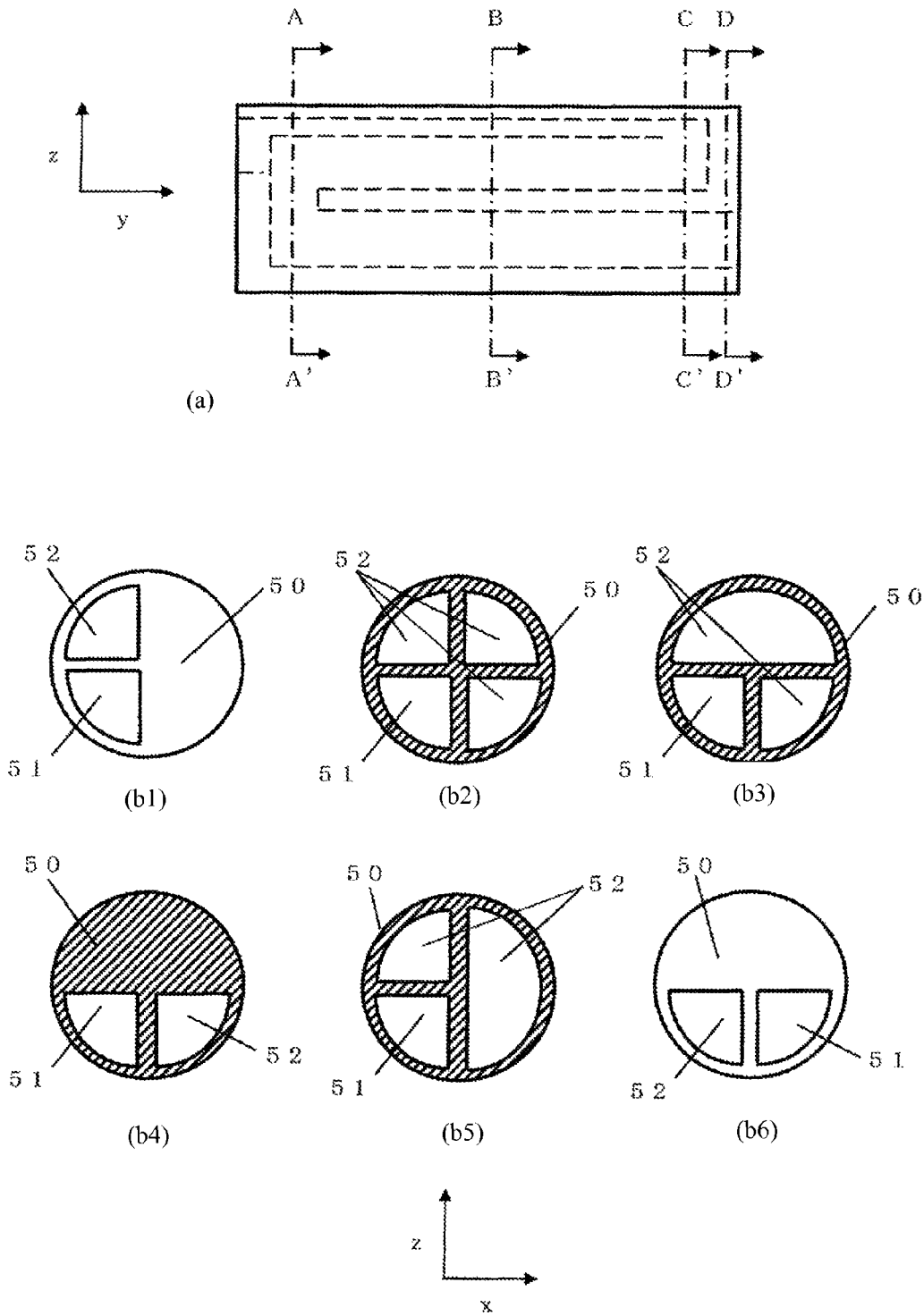
FIG. 13 are side views of the sound leading portion in which the folded type sound leading pipe is installed.

The structure of the sound leading pipe 52 will be further described by referring to FIG. 13. FIG. 13(*a*) is a side view (symmetric) of the sound leading portion 50 in which the folded sound leading pipe 52 is installed. A broken line virtually shows the sound leading pipe 52 inside the sound leading portion 50 not at an actual position so that it can be understood intuitively. FIG. 13(*b*1) and FIG. 13(*b*6) are a front view and a rear view of the sound leading portion 50. FIG. 13(*b*2) to FIG. 13(*b*5) are sectional views of the sound leading portion 50.

FIG. 13(*b*1) is a front view of the sound leading portion 50 when seen in the positive direction of the y-axis from the left side in the figure. By placing the y-axis on the center line of the columnar sound leading portion 50, the sound leading pipe 51 is located in the third quadrant on the xz plane, and the sound leading pipe 52 is located in the second quadrant on the xz plane.

FIG. 13(*b*2) is a sectional view at the position shown by B-B' in FIG. 13(*a*). The path of the sound leading pipe 51 is seen in the third quadrant on the xz plane, the path through which the sound leading pipe 51 advances from the entrance on the front in the positive direction of the y-axis is seen in the second quadrant, and the path through which the sound leading pipe 52 returns in the negative direction of the y-axis is seen in the first quadrant. Moreover, in the fourth quadrant on the xz plane, the path through which the sound leading pipe 52 advances in the positive direction of the y-axis toward the exit on the rear face on the right side in FIG. 13(*a*).

FIG. 13(*b*3) is a sectional view at the position shown by C-C' in FIG. 13(*a*). The sound leading pipe 52 is shown to expand from the second quadrant to the first quadrant on the xz plane and to bend in the x-axis direction so as to connect the path passing through the second quadrant and the first quadrant.

FIG. 13(*b*4) is a sectional view at the position shown by D-D' in FIG. 13(*a*). At this position, the sound leading pipe 52 expanding from the second quadrant to the first quadrant on the xz plane in the sectional view at the position shown by C-C' is not seen, and it is understood that the sound leading pipe 52 does not penetrate to the rear face on the right side of the sound leading portion 50 at the position where the sound leading pipe 52 expands from the second quadrant to the first quadrant on the xz plane.

FIG. 13(*b*5) is a sectional view at the position shown by A-A' in FIG. 13(*a*). The sound leading pipe 52 is shown to expand from the first quadrant to the fourth quadrant on the xz plan and to bend in the z-axis direction so as to connect the path passing through the first quadrant and the fourth quadrant. After reaching the path passing through the fourth quadrant, the sound leading pipe 52 advances in the positive direction of the y-axis again and then, the section seen in FIG. 13(*b*2) is seen again.

Finally, the sound leading pipe 52 reaches the rear face on the right side of the columnar sound leading portion 50. At this time, when the sound leading portion 50 is viewed in the negative direction of the y-axis from the right side in the figure, the rear face of the FIG. 13(*b*6) is seen. Changing the viewing direction to the opposite side where the direction of the x-axis is different, the sound leading pipe 51 is present in the third quadrant on the xz plane, while the sound leading pipe 52 is present in the fourth quadrant.

The sound leading portion 50 is made by molding or cutting hard plastic, metal and the like in several members and by assembling them.

The sound wave enters the sound leading portion 50 from the left side through each of the two sound leading pipes and passes therethrough to the right side of the sound leading portion 50. Since the first sound leading pipe 51 has a linear shape, the length is equal to that of the sound leading portion 50. The second sound leading pipe 52 in this embodiment is folded twice inside the sound leading portion 50 and its whole length is a length obtained by adding twice the length of a folded portion 53 to the length of the sound leading portion 50.

Similarly to the embodiment 1, in order to have the difference in length of the two sound leading pipes of 28.3 mm, it is only necessary to set the length of the folded portion 53 to 14.2 mm. If the length of the sound leading portion 50 is 16 mm, for example, a folded portion 53 having the length of 14.2 mm can be housed inside.

If it is desired that the length of the sound leading portion 50 is shorter than 16 mm, the lengths of the sound leading portion 50 and the folded portion 53 may be made shorter and instead, the number of folding times may be increased to 4 times, for example.

Figure 14:
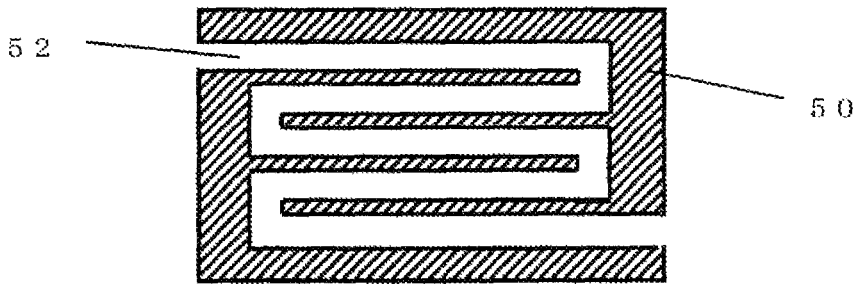
FIG. 14 is a schematic diagram of a cubic structure of a sound leading portion having a sound leading pipe folded four times.

FIG. 14 shows a cubic structure of the sound leading portion 50 having the sound leading pipe 52 folded 4 times as a schematic diagram. This is a schematic sectional view provisionally expanded on a plane so that the cubic folded structure of the sound leading pipe 52 can be understood easily.

In this case, the object can be achieved by setting the length of the folded portion 53 to 7.1 mm and the length of the sound leading portion 50 to 10 mm, for example. According to this, the difference in length of the two sound leading pipes is approximately 28.3 mm, and the same frequency characteristics can be obtained.

Thus, the difference in length between the path passing through the first sound leading pipe 51 and the path passing through the second sound leading pipe 52 becomes the half wavelength of the sound wave with 6 kHz, a trough is generated at the position around the frequency of 6 kHz in the frequency characteristics, and acoustic damping can be realized.

The advantages of this embodiment 2 are shown in FIG. 15 similarly to the embodiment 1. Detailed description will be omitted to avoid duplication.

REFERENCE SIGNS LIST

1 external housing
2 electro-acoustic transducer
3 lead wire
4 sound leading portion
5 ear pad
6 acoustic resistor
7 external auditory canal entrance

8 external auditory canal
9 eardrum
10 sound-isolating earphone
11 linear sound leading pipe
12 U-shaped sound leading pipe descent part
13 U-shaped sound leading pipe lateral part
14 U-shaped sound leading pipe ascent part
15 sound emitting port
21 coil
22 permanent magnet
23 diaphragm
30 human body
41 first cylindrical member
42 second cylindrical member
43 first sound leading pipe, hole
44 second sound leading pipe, groove
50 sound leading portion
51 first sound leading pipe
52 second sound leading pipe
53 folded portion
521 entrance
522 entrance-side straight path
523 lateral path
524 return path
525 vertical path
526 exit-side straight path
527 exit

The invention claimed is:

1. A sound-isolating earphone used by inserting a sound emitting portion into an external auditory canal entrance, comprising:

an electro-acoustic transducer for generating a sound wave; and two independent sound leading pipes having different path lengths as a sound leading portion which transfers the sound wave generated from the electro-acoustic transducer to the external auditory canal entrance, wherein two sound waves generated from the electro-acoustic transducer and having passed through the two sound leading pipes are synthesized at the external auditory canal entrance, the path length difference between the two sound leading pipes is substantially equal to an interval between a sound emitting port of the sound-isolating earphone located in the vicinity of the external auditory canal entrance and the eardrum located in the depth of the external auditory canal, and a frequency equal to a primary resonance frequency of a both-end closed pipe resonance space is suppressed.

2. The sound-isolating earphone according to claim 1, wherein the sound leading portion which transfers the sound wave generated from the electro-acoustic transducer to the external auditory canal entrance is formed of a double cylindrical member;

a helical groove is formed in an outer periphery of a second cylindrical member fitted in the inside of a first cylindrical member on the outside; and a first sound leading pipe, which is a linear path forming an inner peripheral face of the second cylindrical member, and a second sound leading pipe, which is a path constituted by an inner peripheral face of the first cylindrical member and the helical groove formed in the outer periphery of the second cylindrical member are provided.

3. The sound-isolating earphone according to claim 1, further comprising:

a first sound leading pipe which connects the electro-acoustic transducer and the external auditory canal entrance to each other by a linear path; and a second sound leading pipe which connects the electro-acoustic transducer and the external auditory canal entrance to each other by a folded path in the sound leading portion which transfers the sound wave generated from the electro-acoustic transducer to the external auditory canal entrance.

4. A sound-isolating earphone used by inserting a sound emitting portion into an external auditory canal entrance, comprising:

an electro-acoustic transducer for generating a sound wave;

a double cylindrical member including a first cylindrical member and a second cylindrical member, the second cylindrical member fitted in an inside of the first cylindrical member, the double cylindrical member forming a sound leading portion that transfers the sound wave generated from the electro-acoustic transducer to the external auditory canal entrance; and a helical groove formed in an outer periphery of the second cylindrical member;

wherein the double cylindrical member comprises:

a first sound leading pipe comprising a linear path forming an inner peripheral face of the second cylindrical member; and a second sound leading pipe comprising an inner peripheral face of the first cylindrical member and the helical groove formed in the outer periphery of the second cylindrical member;

wherein the first sound leading pipe and the second sound leading pipe have different path lengths;

wherein the sound wave generated from the electro-acoustic transducer separates to travel through the first sound leading pipe and the second sound leading pipe, and having passed through the first sound leading pipe and the second sound leading pipe is synthesized at the external auditory canal entrance; and a sound pressure of a frequency having the path length difference of the first sound leading pipe and the second sound leading pipe as a half wavelength is suppressed.

5. The sound-isolating earphone according to claim 4, wherein the path length difference between the first sound leading pipe and the second sound leading pipe is substantially equal to an interval between a sound emitting port of the sound-isolating earphone located in the vicinity of the external auditory canal entrance and the eardrum located in the depth of the external auditory canal, and primary resonance frequency in a both-end closed pipe resonance space constituted between the sound emitting port and the eardrum is suppressed.

6. A sound-isolating earphone used by inserting a sound emitting portion into an external auditory canal entrance, comprising:

an electro-acoustic transducer for generating a sound wave;

a first sound leading pipe which connects the electro-acoustic transducer and the external auditory canal entrance to each other by a linear path;

a second sound leading pipe which connects the electro-acoustic transducer and the external auditory canal entrance to each other by a folded path;

wherein the first sound leading pipe and the second sound leading pipe have different path lengths as a sound leading portion which transfers the sound wave generated from the electro-acoustic transducer to the external auditory canal entrance;

wherein two sound waves generated from the electro-acoustic transducer and having passed through first sound leading pipe and the second sound leading pipe are synthesized at the external auditory canal entrance; and wherein a sound pressure of a frequency having the path length difference of the first sound leading pipe and the second sound leading pipe as a half wavelength is suppressed.

7. The sound-isolating earphone according to claim 6, wherein the path length difference between the first sound leading pipe and the second sound leading pipe is substantially equal to an interval between a sound emitting port of the sound-isolating earphone located in the vicinity of the external auditory canal entrance and the eardrum located in the depth of the external auditory canal, and primary resonance frequency in a both-end closed pipe resonance space constituted between the sound emitting port and the eardrum is suppressed.

* * * * *